US012546567B2

(12) United States Patent
Alldredge et al.

(10) Patent No.: US 12,546,567 B2
(45) Date of Patent: Feb. 10, 2026

(54) METHODS FOR AIMING A FIREARM RELATIVE TO A DISTURBED POINTER AND SYSTEMS THEREOF

(71) Applicant: B.E. Meyers & Co., Inc., Redmond, WA (US)

(72) Inventors: Thomas Alldredge, Clinton, WA (US); Alexander Bigby, Redmond, WA (US); Miles Elledge, Woodinville, WA (US); Spencer Nelson, Kirkland, WA (US)

(73) Assignee: B.E. Meyers & Co., Inc., Redmond, WA (US)

( * ) Notice: Subject to any disclaimer, the term of this patent is extended or adjusted under 35 U.S.C. 154(b) by 0 days.

(21) Appl. No.: 18/836,639

(22) PCT Filed: Feb. 6, 2023

(86) PCT No.: PCT/US2023/012405

§ 371 (c)(1),
(2) Date: Aug. 7, 2024

(87) PCT Pub. No.: WO2023/183092

PCT Pub. Date: Sep. 28, 2023

(65) Prior Publication Data

US 2025/0116486 A1 Apr. 10, 2025

Related U.S. Application Data

(60) Provisional application No. 63/307,953, filed on Feb. 8, 2022.

(51) Int. Cl.

| | |
|---|---|
| ***F41G 3/06*** | (2006.01) |
| ***F41G 3/08*** | (2006.01) |
| ***F41G 3/14*** | (2006.01) |

(52) U.S. Cl.
CPC ..... *F41G 3/06* (2013.01); *F41G 3/08* (2013.01); *F41G 3/145* (2013.01)

(58) Field of Classification Search
CPC ... F41G 3/06; F41G 3/08; F41G 3/145; F41G 1/35
See application file for complete search history.

(56) References Cited

U.S. PATENT DOCUMENTS 8,347,543 B1 1/2013 Smith
9,062,933 B1 * 6/2015 Allen ..... F21V 21/34
(Continued)

FOREIGN PATENT DOCUMENTS

AU 2014308679 A1 * 4/2016 ..... G01S 17/10
CA 2996381 A1 * 3/2017 ..... F41G 3/165

OTHER PUBLICATIONS

International Search Report and Written Opinion for PCT Application No. PCT/US2023/012405 mailed Oct. 10, 2023, 14 pages.
(Continued)

*Primary Examiner* — Tuyen K Vo
(74) *Attorney, Agent, or Firm* — Amin, Turocy & Watson, LLP

(57) ABSTRACT

Aiming a firearm via a disturbed pointer is disclosed and can include receiving a mounting position of a ballistic aiming system with respect to a boresight of the firearm, a detected cant of the firearm, and a determined range to a target. An adjusted aiming solution for the target can be determined based on the mounting position, the detected cant, and the determined range. A projectable pattern of one or more elements can be generated, wherein an element of the elements can be related to a disturbed pointer corresponding to the adjusted aiming solution for the target. A light source can be controlled to output a portion of the projectable pattern of one or more elements comprising the element related to the disturbed pointer, wherein the disturbed
(Continued)

pointer can be projected as the adjusted aiming solution for the target.

20 Claims, 3 Drawing Sheets

(56) References Cited

U.S. PATENT DOCUMENTS

| | | | | |
|---|---|---|---|---|
| 9,335,122 | B2 * | 5/2016 | Choiniere | F41G 1/54 |
| 10,107,592 | B1 * | 10/2018 | Huang | F41G 11/003 |
| 10,955,218 | B1 | 3/2021 | Drake | |
| 11,009,315 | B1 * | 5/2021 | Huang | F21S 9/02 |
| 2012/0198748 | A1 * | 8/2012 | Ospino Orozco | F41G 1/35 42/117 |
| 2013/0235609 | A1 * | 9/2013 | Nemeyer | G02B 6/0001 362/553 |
| 2013/0286216 | A1 * | 10/2013 | Lupher | H04N 23/6811 348/169 |
| 2014/0215876 | A1 * | 8/2014 | Popa-Simil | F41G 3/12 42/1.06 |
| 2015/0176949 | A1 | 6/2015 | Varshneya et al. | |
| 2016/0377378 | A1 | 12/2016 | Collin | |
| 2017/0357002 | A1 | 12/2017 | Winker et al. | |
| 2019/0145733 | A1 | 5/2019 | Chung | |
| 2019/0293388 | A1 | 9/2019 | Barrett et al. | |
| 2021/0247165 | A1 | 8/2021 | Tello | |
| 2021/0348886 | A1 | 11/2021 | Havens et al. | |

OTHER PUBLICATIONS

Notification Concerning Transmittal Of International Preliminary Report on Patentability for PCT Application No. PCT/US2023/012405 mailed Aug. 22, 2024, 12 pages.

European Office Action mailed Sep. 17, 2024 for European Patent Application No. 23775428.8, 3 pages.

Extended European Search Report received for European Patent Application Serial No. 23775428.8 dated Dec. 22, 2025, 9 pages.

* cited by examiner

METHODS FOR AIMING A FIREARM RELATIVE TO A DISTURBED POINTER AND SYSTEMS THEREOF

This application is a U.S. National Stage filing under 35 U.S.C. § 371 of, and claims priority to, international patent cooperation treaty (PCT) Application No. PCT/US2023/012405, filed Feb. 6, 2023, and entitled "METHODS FOR AIMING A FIREARM RELATIVE TO A DISTURBED POINTER AND SYSTEMS THEREOF", each of which applications further claim priority to U.S. Provisional Patent Application No. 63/307,953, filed on Feb. 8, 2022, which priority applications are hereby incorporated by reference herein in their respective entireties.

FIELD

This technology relates to aiming a firearm relative to a disturbed pointer.

BACKGROUND

There are a variety of conditions when there may be challenges presented with respect to accurately aiming a firearm for a desired target. For example, a firearm operator may desire to engage a target with a firearm at night at known ranges great enough to require compensation for the trajectory of the projectile. However, the firearm may not be equipped with a night vision device and a visible light optic that includes a reticle or night vision scope with reticle making aiming of the firearm to engage the target challenging.

By way of another example, a firearm operator may again desire to engage a target with a firearm, but also may desire to use head borne night vision goggles (NVGs). In this situation, the firearm operator while using the NVGs may be unable or unwilling to get behind the visible light optic that includes a reticle or night vision scope with reticle making aiming of the firearm to engage the target challenging.

As a result, in each of these examples, as well as in other conditions, the firearm operator is not able to "hold the aiming point high" well enough to accurately engage the target as illustrated by way of example with the green "Zeroed Laser Aiming Point" solution 52 in FIG. 2.

SUMMARY

A method for aiming a firearm can include receiving, by an aiming computing device, a determined range to a target, such as from a range finder system. An adjusted aiming solution for the target can be determined, by the aiming computing device, based on the determined range. A projectable pattern of one or more elements can be determined, by the aiming computing device, with an element of the elements being a disturbed pointer for the adjusted aiming solution for the target. In some examples, the aiming computing device can determine a projectable pattern having more than one element of the elements effecting the disturbed pointer for the disturbed aiming point. The zeroed aiming point can differ from the disturbed aiming point corresponding to the disturbed pointer. A light source can be controlled, by the aiming computing device, to output a portion of the projectable pattern of one or more elements, the portion comprising the element that is the disturbed pointer. This can result in the disturbed pointer representing an adjusted aiming solution for the target, e.g., blue "Disturbed Laser Aiming Point" 50 of FIG. 2.

A ballistic aiming system can include a light source, an accelerometer, and an aiming computing device that can be coupled to the light source and accelerometer. The aiming computing device can comprise memory that comprises programmed instructions stored thereon and one or more processors configured to be capable of executing the stored programmed instructions to: receive a determined range to a target, such as from a range finder system; determine an adjusted aiming solution for the target based on the determined range. Executing the stored programmed instructions can enable determining a projectable pattern of elements comprising an element of the elements that can be a disturbed pointer for the disturbed aiming point for the target. A zeroed aiming point can differ from the disturbed aiming point for the target that can be indicated by the disturbed pointer. Executing the stored programmed instructions can facilitate controlling the light source to output a portion of the projectable pattern of one or more elements, the portion comprising the element that is the disturbed pointer which can indicate the adjusted aiming solution that can be brought onto the target T by manipulation of the firearm F, e.g., the firearm F in FIG. 1, etc.

This technology provides a number of advantages that can comprise accurate and effective aiming of a firearm with a disturbed pointer in a variety of different conditions in comparison to a firearm without a disturbed pointer. With examples of this technology, a disturbed laser aiming point for the target can be generated and provided without requiring the operator to get behind a visible light optic, such as a reticle or night vision scope, providing greater flexibility for the firearm operator under a variety of different conditions.

DETAILED DESCRIPTION

Figure 1:
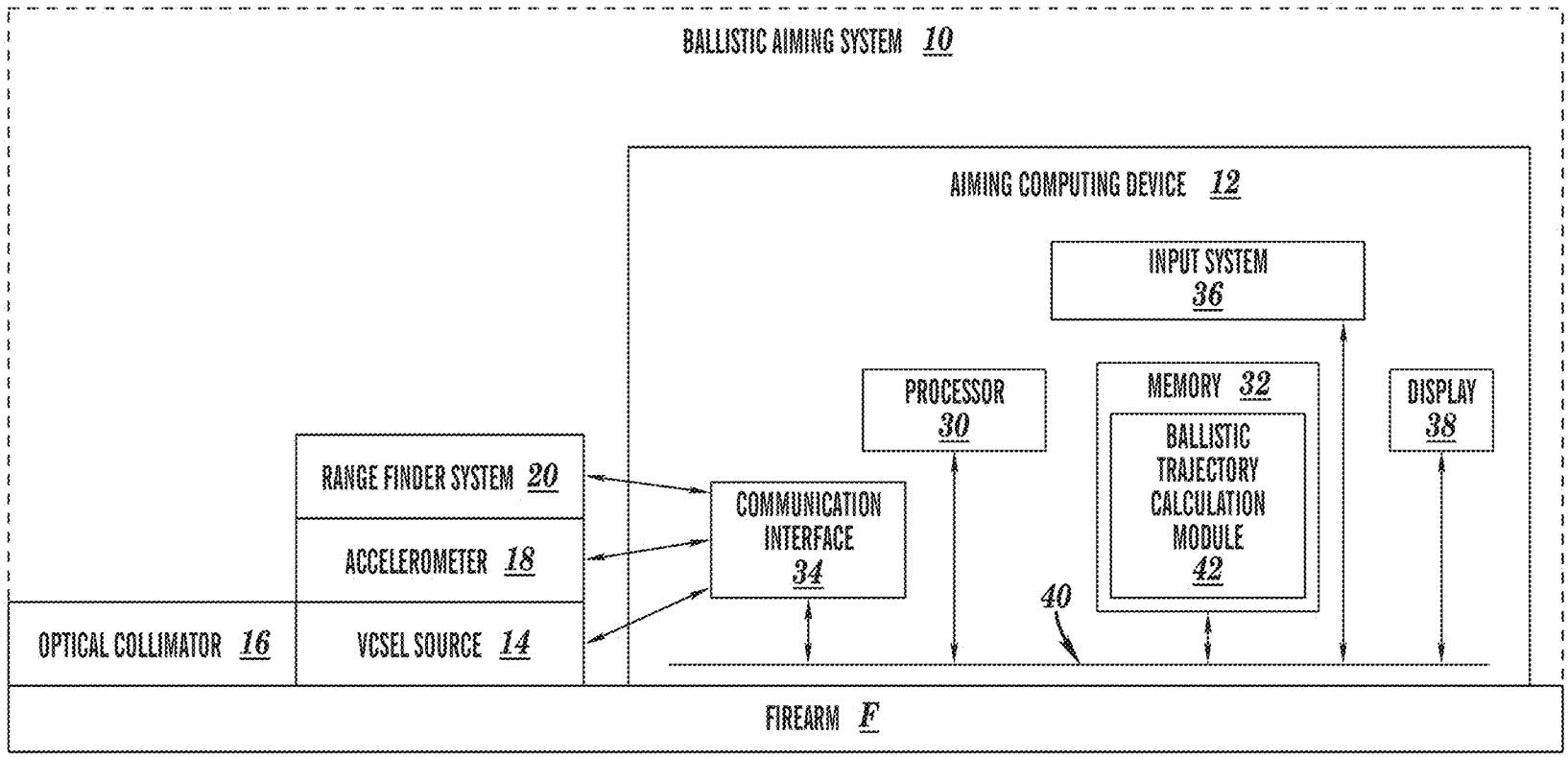
FIG. 1 is a diagram of a firearm equipped with an exemplary ballistic aiming system.

An exemplary ballistic aiming system 10 is illustrated in FIG. 1. In this example, the ballistic aiming system 10 can comprise an aiming computing device 12, a vertical cavity surface emitting laser (VCSEL) source 14, an optical collimator 16, an accelerometer 18, and a range finder system 20, although the system may have other types and/or numbers of other systems, devices, components, and/or other elements in other configurations. In an example, accelerometer 18 can be separate from, but communicatively coupled to, aiming computing device 12. In an example, range finder system 20 can be separate from, but communicatively coupled to aiming computing device 12. In an example, accelerometer 18 can be comprised in aiming computing device 12. In an example, range finding system 20 can be comprised, at least in part, in aiming computing device 12. This technology can provide a number of advantages, which can comprise providing a method, a system, a device, etc., for accurate aiming of a firearm with a disturbed pointer under a variety of different conditions.

The aiming computing device 12 can comprise a processor 30, memory 32, a communication interface 34, an input system 36, and a display 38 which can be communicatively coupled via a bus or other link 40, although the device can have other systems, devices, components, and/or other elements in other exemplary configurations. The processor 30 of the aiming computing device 12 can execute programmed instructions, such as programmed instructions that can be stored in the memory 32 of the aiming computing device 12, for any number of functions, such as functions illustrated and described by way of the examples herein.

The memory 32 of the aiming computing device 12 can store programmed instructions for one or more aspects of the present technology, as illustrated and described by way of the examples herein, although some or all of the programmed instructions can be stored elsewhere. A variety of different types of memory storage devices, such as random-access memory (RAM), read only memory (ROM), hard disk, solid state drives, flash memory, or another computer readable medium which can be read via processor 30, can be used for the memory 32. In some examples, the memory 32 can be written to via a corresponding writing technology.

Figure 2:
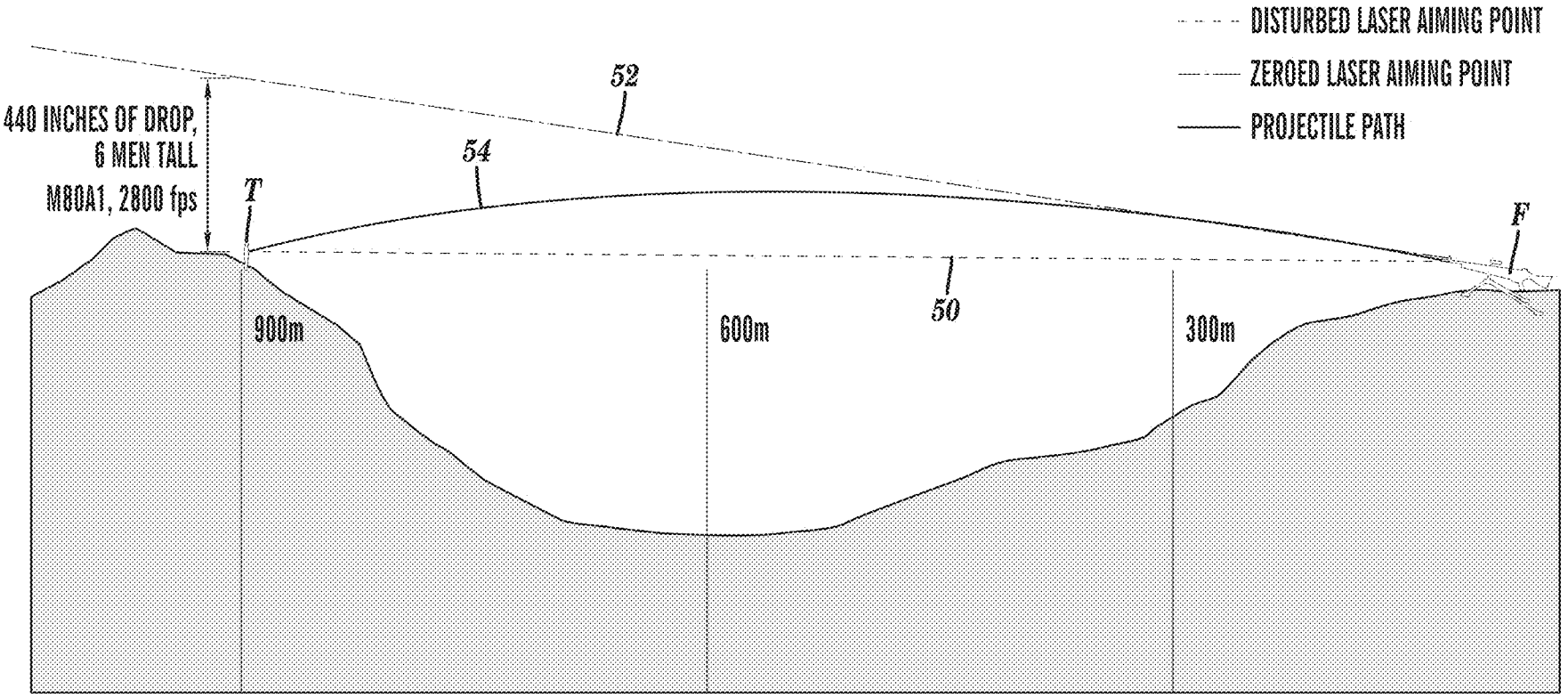
FIG. 2 is a diagram illustrating an example of a trajectory of a projectile from a firearm to a target.
Figure 3:
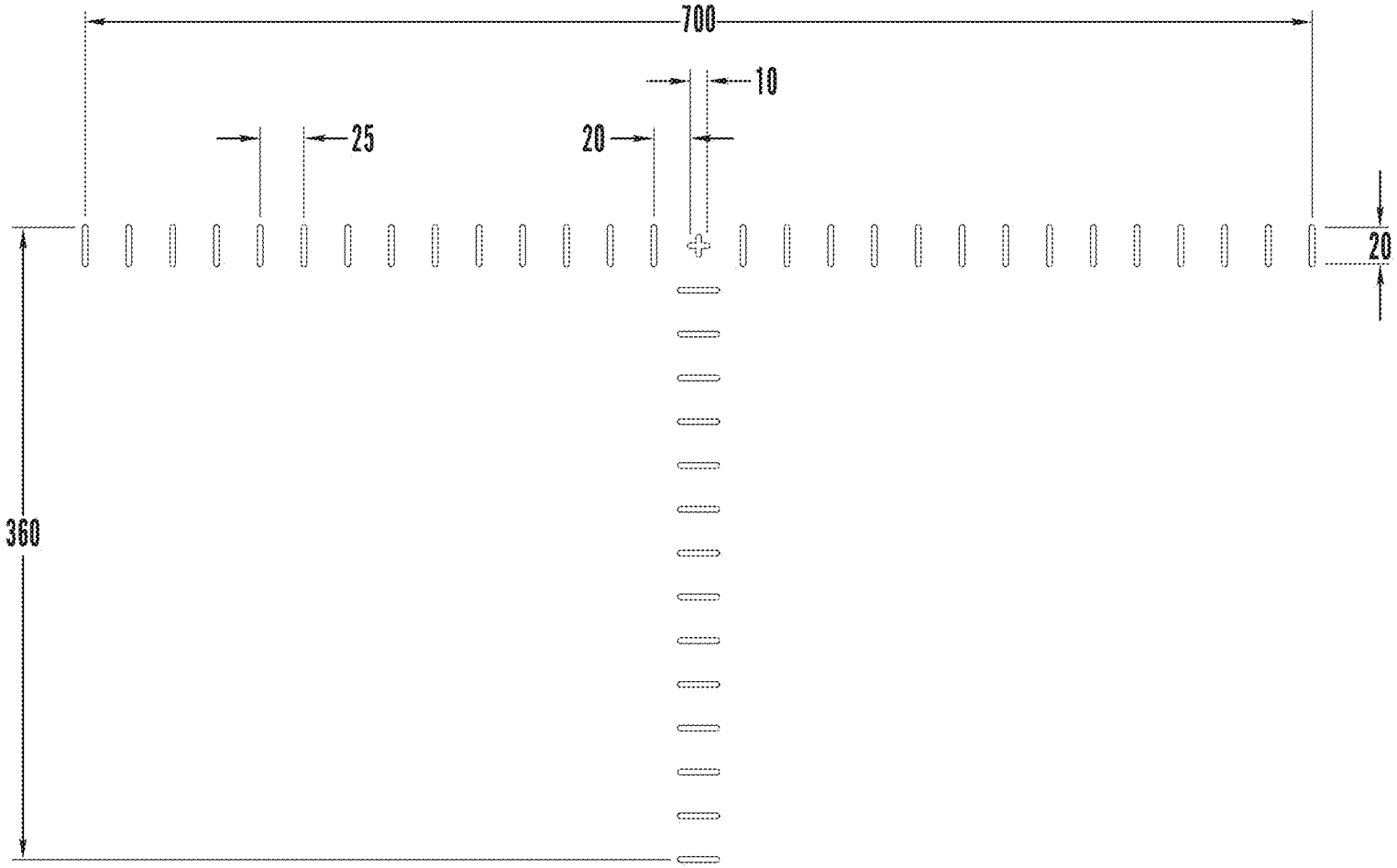
FIG. 3 is a diagram of a laser source aiming emission pattern that can be generated with the exemplary ballistic aiming system shown in FIG. 1.

Accordingly, the memory of the aiming computing device 12 can store one or more applications that can include computer executable instructions that, when executed by the aiming computing device 12, can cause the aiming computing device 12 to perform actions, such as to assist with aiming a firearm F, for example, and to perform other actions illustrated and described by way of the examples herein with reference to FIGS. 1-3. The application(s) can be implemented as modules or components of other applications. Further, the application(s) can be implemented as operating system extensions, module, plugins, or the like. In an example, the memory 32 of the aiming computing device 12 can include an onboard ballistic trajectory calculation module 42 to determine an angular adjustment of a disturbed pointer to compensate for a calculated perturbation of a projectile, e.g., a drop due to gravitational force during a time of flight of the projectile, drag on the projectile due to air density, rotation due to the Coriolis force, bullet diameter, bullet length, bullet weight, ballistic coefficient type, ballistic coefficient, muzzle velocity, spin drift direction, twist rate, sight height index, etc., at the determined range and can also take into account other factors, such as an environmental condition factor, a cant of the firearm F factor, and a position of the ballistic aiming system 10 on the firearm F factor, etc., by way of example. The memory 32 can include other types and/or numbers of other application, modules, programmed instructions and/or databases.

The communication interface 34 of the aiming computing device 12 can operatively couple and communicate between the aiming computing device 12 and the VCSEL source 14, the accelerometer 18, and the range finder system 20, although the communication interface 34 may be coupled to other types and/or numbers of other systems, devices, components and/or other elements. Additionally, other types and/or numbers of communication techniques and/or coupling configurations can be employed.

The input system 36 can comprise one or more input devices or other systems facilitating entering information into the aiming computing system 12. Input system 36 can comprise, for example, a keyboard, a touchscreen, a voice activated system, or another input device. The display 38 can comprise any type of display system, such as an LED screen, LCD screen, etc., that, by way of example, can display an image, a video, information, etc., such as a projectable pattern that can be determined by the aiming computing device 12.

The examples of this technology can also be embodied as one or more non-transitory computer readable media having instructions stored thereon for one or more aspects of the present technology as described and illustrated by way of the examples herein. The instructions in some examples include executable code that, when executed by one or more processors, can cause the processors to carry out steps necessary to implement the methods of the examples of this technology that are described and illustrated by way of the examples herein.

The VCSEL source 14 can be a light source that can be driven based on a received control input from the aiming computing device 12, e.g., via communication interface 34, etc., and can provide a light source output that can be used to engage a target. VCSEL source 14 can be a source of laser light. In some examples, sources of other types of light can be employed in lieu of, or in addition to, VCSEL source 14. VCSEL source 14 can be, in an example, coupled to the aiming computing device 12 and can be configured to create a projectable pattern of emission points e.g., which can be projected via the optical collimator 16 or other collimating optics, as an adjusted aiming solution for the firearm F to engage a desired target T, such as the projectable pattern illustrated in FIG. 3. An arrangement of laser diodes comprising the VCSEL source 14 can therefore correspond to the projectable pattern and the measurement units illustrated in FIG. 3 can indicate distances among the laser diodes of the VCSEL source 14, which measurement units can be in microns, although other measurement units and/or spacing/arrangement among the laser diodes of the VCSEL source 14 can be used. Each element of the projectable pattern can correspond to one or more laser diodes of the VCSEL source 14 that can be individually addressable enabling any combination of elements, including all elements, to be controllably turned on or off, e.g., projected or not projected, which can assist with providing an adjusted aiming solution via a disturbed pointer. In an example, an orientation of the projectable pattern can be an inverted orientation behind the optical collimator 16 to depict by way of example the aiming solution shown in FIG. 3 as optically projected into the far field. In FIG. 3, an example projectable pattern is illustrated that can correspond to a VCSEL source 14 that can comprise, for example, three groups of laser diodes that can correspond to three orientations of aiming system 10 relative to firearm F in FIG. 1, e.g., illustrated vertical column in the projectable pattern can correspond to a first group of laser diodes of the VCSEL source 14 that can be employed to assist in targeting, via a disturbed pointer, relative to a first mounting position of the aiming system 10 relative to firearm F in FIG. 1, such as a "twelve o'clock" position; illustrated left row (left of the "+" in FIG. 3) in the projectable pattern can correspond to a second group of laser diodes of the VCSEL source 14 that can be employed to assist in targeting, via the disturbed pointer, relative to a second mounting position of the aiming system 10 relative to firearm F in FIG. 1, such as a "nine o'clock" position; illustrated right row (right of the "+" in FIG. 3) in the projectable pattern can correspond to a third group of laser diodes of the VCSEL source 14 that can be employed to assist in targeting, via the disturbed pointer, relative to a third mounting position of the aiming system 10 relative to firearm F in FIG. 1, such as a "three o'clock" position. In this example, the disturbed pointer can be an IR laser operating at 850-860 nm for use with night vision googles, although other types of light sources in other wavelengths can be used in other examples.

The optical collimator 16 can be coupled with the VCSEL source 14 and can be configured to focus a laser beam output from the VCSEL source 14 in a direction towards an adjusted aiming solution, e.g., towards the target T. In an example, the VCSEL source 14 can be positioned at or near a focus point of the optical collimator 16. A focal length of the optical collimator 16 can be employed to appropriately scale the optical collimator 16 to a calculated angular pitch of a projected portion of the projectable pattern corresponding to a linear pitch of laser diodes comprising the VCSEL source 14. In this example, a portion of a projectable pattern, wherein the portion comprises an element representing the disturbed pointer, can be projected down range by VCSEL source 14 via optical collimator 16, enabling an operator to bring the disturbed pointer, which can be an IR laser, onto target T to facilitate accurate aiming of a projectile towards target T.

The accelerometer 18 can be coupled to the aiming computing device 12 and can be configured to detect an orientation of the mounting position of the ballistic aiming system 10 with respect to the firearm F, such as left ("nine o'clock position"), top ("twelve o'clock position"), or right ("three o'clock position") of firearm F by way of example, or changes thereto, and a cant of the firearm F, e.g., an elevation, rotation, declination, etc., or combination thereof, although the accelerometer 18 could provide other types of data and other types and/or numbers of sensors may be used.

The range finder system 20 can be mounted in a weapon mounted laser device housing for the ballistic aiming system 10 and can be coupled to the aiming computing device 12, such as via communication interface 34, etc., although in other examples an external rangefinder can be used, e.g., can be communicatively coupled to or otherwise used, to obtain range data which can be input to the aiming computing device 12 by way of example. In an example, the range finder system 20 can be configured to determine a range to a desired target which can be communicated to the aiming computing device 12, although the range finder system 20 can obtain and provide other types of data for aiming in other examples.

An exemplary method for aiming a firearm F is now described with reference to FIGS. 1-3. In this example, the ballistic aiming system 10 can be packaged in a housing, typically intended to be mounted on a weapon, that allows for boresighting of the ballistic aiming system 10 and generally enables adjustably mounting the housing to a rail of the firearm F, although other manners for mounting can be used.

The range finder system 20 of the ballistic aiming system 10 can be used to discern a range to a desired target T, for example when the ballistic aiming system 10 is engaged for target T, although other approaches for determining this range or distance may be used. Additionally, in this example the accelerometer 18 of the ballistic aiming system 10 can be used to detect or sense a mounting position of the ballistic aiming system 10 with respect to the firearm F, such as to the left, top, or right of firearm F, and can also be able to detect or sense a cant of the firearm F, e.g., elevation/declination, rotation around a longitudinal axis of firearm F, etc., although in other examples the mounting position can be obtained in other manners, such as by prior input of the mounting position by the operator, and other positioning and/or orientation data may be used. In some examples the cant of the firearm F, or deviation from an acceptable cant of the firearm F, can be communicated to the operator, such as by display 38, audio alert, a haptic alert, etc. Further, in other examples, the ballistic aiming system 10 can obtain another type of data that can be employed in determining an aiming solution, such as a current environmental condition (such as an atmospheric pressure, for example a station pressure, humidity, temperature, etc., by way of example), from a sensor, by current or prior operator input, etc., at or prior to the time of use, e.g., via input system 36, by connection to and retrieval from other sources of this data, e.g., sensors, etc., or other types and/or combinations of data that can be obtained to facilitate determination of a targeting solution.

The detected range to the target from the range finder system 20, the detected cant of the firearm F, and the mounting position of the ballistic aiming system can be input into the onboard ballistic trajectory calculation module 42 in the aiming computing device 12 which can be executed to determine an adjusted aiming solution for the target T which can compensate for the drop of a projectile fired from the firearm F over the determined range, although again other types of data, such as current environmental conditions (such as station pressure, humidity and/or temperature) can also be entered and used in determining the adjusted laser aiming point solution. By way of example, one of a variety of ballistic computation formulas, which are well known to those of ordinary skill in the art, can be programmed and used.

As shown in the example in FIGS. 2 and 3, the aiming computing device 12 can execute the onboard ballistic trajectory calculation module 42 to generate information that can be employed to control and generate, with the VCSEL source 14 and the optical collimator 16, a projected pattern of the projectable pattern that can comprise one or more elements with at least one element that is a disturbed pointer that is projected and provides an indication for accurately aiming a firearm F at the target T. Where the disturbed pointer, while the firearm F is aligned with the determined zeroed laser aiming point, is not incident on the target T, the firearm can be manipulated to the adjusted aiming solution to place the disturbed pointer on the target T, so as to facilitate engaging the target T with a projectile fired from firearm F. In an example, the projectable pattern can comprise a plurality of elements arranged in a "T-shape" with a center element of the projectable pattern generated by VCSEL source 14 shown as a "+", which can indicate the zeroed laser aiming point solution 52 in FIG. 3, such as can result from boresighting the firearm, however the disclosed subject matter is not limited to this example and nearly any other pattern can be used, the center and/or other elements can be any shape appropriate for targeting, such as an "o" or a "dot" by way of example; the center element can be absent; a targeting demarcation can be off-center, etc. As shown in the example in FIG. 2 the determined zeroed laser aiming point solution 52, to which the firearm F can be aligned, can differ from a "Disturbed Laser Aiming Point" 50 for the disturbed pointer used to point at the target T. When the disturbed pointer, in this example, is aligned with the target T, then a projectile fired from the firearm F can hit the target T as shown in path 54.

Accordingly, with this generated projectable pattern that enables the compensations discussed herein, a firearm operator can advantageously aim the firearm F at the desired target T without getting behind a visible light optic that may include a reticle or night vision scope with reticle, providing greater flexibility for the firearm operator for a variety of different conditions. As a result, as illustrated and described by way of the examples herein, this technology provides methods and systems for accurately and effectively aiming a firearm F relative to a pointer in a variety of different conditions.

Having thus described the basic concept of the invention, it will be rather apparent to those skilled in the art that the foregoing detailed disclosure is intended to be presented by way of example only and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations, therefore, is not intended to limit the claimed processes to any order except as may be specified in the claims. Accordingly, the invention is limited only by the following claims and equivalents thereto.

What is claimed is:

1. A method for aiming, the method comprising:

receiving, by an aiming computing device, a determined range to a target;

determining, by the aiming computing device, an adjusted aiming solution for the target based on the determined range to the target;

determining, by the aiming computing device and from among a projectable pattern comprising one or more elements, an element of the projectable pattern representing a disturbed pointer for the adjusted aiming solution for the target; and controlling, by the aiming computing device, a light source to project the element of the projectable pattern in a downrange direction towards the target.

2. The method of claim 1, further comprising:

receiving, by the aiming computing device, a mounting position of a ballistic aiming system, comprising the aiming computing device, relative to a firearm, wherein the determining of the adjusted aiming solution for the target is further based on the mounting position of the ballistic aiming system.

3. The method of claim 2, wherein the receiving of the mounting position of the ballistic aiming system further comprises:

receiving, by the aiming computing device, the mounting position of the ballistic aiming system from an accelerometer.

4. The method of claim 2, wherein the receiving of the mounting position of the ballistic aiming system further comprises:

receiving, by the aiming computing device, the mounting position of the ballistic aiming system as an input from an operator of the firearm.

5. The method of claim 1, further comprising:

receiving, by the aiming computing device, a detected cant of a firearm wherein the determining of the adjusted aiming solution for the target is further based on the detected cant of the firearm.

6. The method of claim 1, wherein the determining of the adjusted aiming point solution for the target is further based on one or more environmental conditions.

7. The method of claim 6, wherein the one or more environmental conditions are selected from a group of conditions comprising a pressure condition, a humidity condition, and a temperature condition.

8. The method of claim 1, wherein the light source comprises a laser diode.

9. The method of claim 8, wherein the laser diode is a vertical cavity surface emitting laser diode.

10. The method of claim 1, wherein the adjusted aiming solution for the target is different from a zeroed laser aiming point for the target.

11. The method of claim 1, wherein the controlling of the light source comprises projecting the element of the projectable pattern in the downrange direction without projecting other elements of the projectable pattern, other than the element, in the downrange direction.

12. A ballistic aiming system, comprising:

a light source; and an aiming computing device coupled to the light source, the aiming computing device comprising memory that comprises programmed instructions stored thereon and one or more processors configured to be capable of executing the stored programmed instructions to:

receive a determined range to a target;

determine an adjusted aiming solution for the target based on the determined range to the target;

determine, from among a projectable pattern comprising one or more elements, an element of the projectable pattern representing a disturbed pointer for the adjusted aiming solution for the target; and control the light source to project the element of the projectable pattern in a downrange direction towards the target.

13. The ballistic aiming system of in claim 12, wherein the programmed instructions further comprise instructions to:

receive a mounting position of a ballistic aiming system relative to a firearm; and determine the adjusted aiming solution for the target further based on the mounting position of the ballistic aiming system.

14. The ballistic aiming system of in claim 13, further comprising an accelerometer coupled to the aiming computing device, wherein the programmed instructions further comprise instructions to:

receive the mounting position of the ballistic aiming system from the accelerometer.

15. The ballistic aiming system of claim 13, wherein the programmed instructions further comprise instructions to:

receive the mounting position of the ballistic aiming system as an input from an operator of the firearm.

16. The ballistic aiming system of claim 12, wherein the programmed instructions further comprise instructions to:

receive a detected cant of the firearm; and determine the adjusted aiming solution for the target further based on the detected cant of the firearm.

17. The ballistic aiming system of claim 12, wherein the programmed instructions further comprise instructions to:

determine the adjusted aiming point solution for the target further based on one or more environmental conditions.

18. The ballistic aiming system of claim 17, wherein the one or more environmental conditions are selected from a group of conditions comprising a pressure condition, a humidity condition, and a temperature condition.

19. The ballistic aiming system of claim 12, wherein the light source comprises a laser diode.

20. The ballistic aiming system of claim 19, wherein the laser diode is a vertical cavity surface emitting laser diode.

* * * * *